US005225665A

United States Patent [19]

Zerfahs et al.

[11] Patent Number: 5,225,665

[45] Date of Patent: Jul. 6, 1993

[54] TICKET ORIGINATING AND PROCESSING DEVICE FOR TRANSIT VEHICLE

[75] Inventors: Arthur S. Zerfahs, Elk Grove; Norman Diamond, Deerfield; Larry E. Zack, Cary, all of Ill.

[73] Assignee: General Signal Corporation, Stamford, Conn.

[21] Appl. No.: 954,421

[22] Filed: Sep. 29, 1992

Related U.S. Application Data

[63] Continuation of Ser. No. 558,594, Jul. 27, 1990, abandoned.

[51] Int. Cl.[5] ..... G07B 15/02

[52] U.S. Cl. ..... 235/384; 235/475; 235/487; 364/407

[58] Field of Search ..... 235/384, 487, 475; 364/407

[56] References Cited

U.S. PATENT DOCUMENTS

| | | | |
|---|---|---|---|
| 3,748,441 | 7/1973 | Halpern | 235/61.6 R |
| 3,776,134 | 12/1973 | Wenger | 101/226 |
| 3,870,866 | 3/1975 | Halpern | 235/61.7 R |
| 3,984,660 | 10/1976 | Oka et al. | 235/384 |
| 4,040,345 | 8/1977 | Adams et al. | 101/66 |
| 4,181,920 | 1/1980 | Cerekas | 360/88 |
| 4,185,730 | 1/1980 | Roes et al. | 194/4 |
| 4,288,688 | 9/1981 | Kiyama | 235/384 |
| 4,357,530 | 11/1982 | Roes et al. | 235/475 |
| 4,365,796 | 12/1982 | Miller | 271/274 |
| 4,367,666 | 1/1983 | Toth | 83/203 |
| 4,374,564 | 2/1983 | Miller et al. | 209/583 |
| 4,376,942 | 3/1983 | Toth et al. | 346/76 |
| 4,377,828 | 3/1983 | Hayman et al. | 360/88 |
| 4,381,705 | 5/1983 | Roes et al. | 101/69 |
| 4,535,892 | 8/1985 | Roes et al. | 209/3.3 |
| 4,579,228 | 4/1986 | Case | 209/563 |
| 4,587,434 | 5/1986 | Roes et al. | 250/556 |
| 4,605,843 | 8/1986 | Aubrey | 235/33 |
| 4,616,128 | 10/1986 | Case | 235/475 |
| 4,732,375 | 3/1988 | Tetherton | 271/176 |
| 4,757,985 | 7/1988 | Hamant et al. | 271/31.1 |
| 4,798,942 | 1/1989 | Aubrey | 235/384 |
| 4,965,438 | 10/1990 | Murofushi | 235/487 |

*Primary Examiner*—Harold Pitts
*Attorney, Agent, or Firm*—John F. Ohlandt

[57] ABSTRACT

A ticket processing device for use on a mass transportation vehicle. A housing, has a substantially horizontal top, provided with an opening therein for receiving a stack of flat cards, and a slot, for accommodating tickets, at said top of said housing spaced from said openings. Within the housing is a U-shaped pathway having a central axis, the central axis of the pathway being linear through a first, vertical portion thereof adjacent to the opening, an elongated cartridge, for accommodating said stack of flat cards, disposed within the first, vertical portion of the pathway. The cartridge has a slot on one sidewall, adjacent the bottom of said cartridge, for permitting the lowest card in the stack at a given time to be expelled.

12 Claims, 6 Drawing Sheets

FIG. 5B
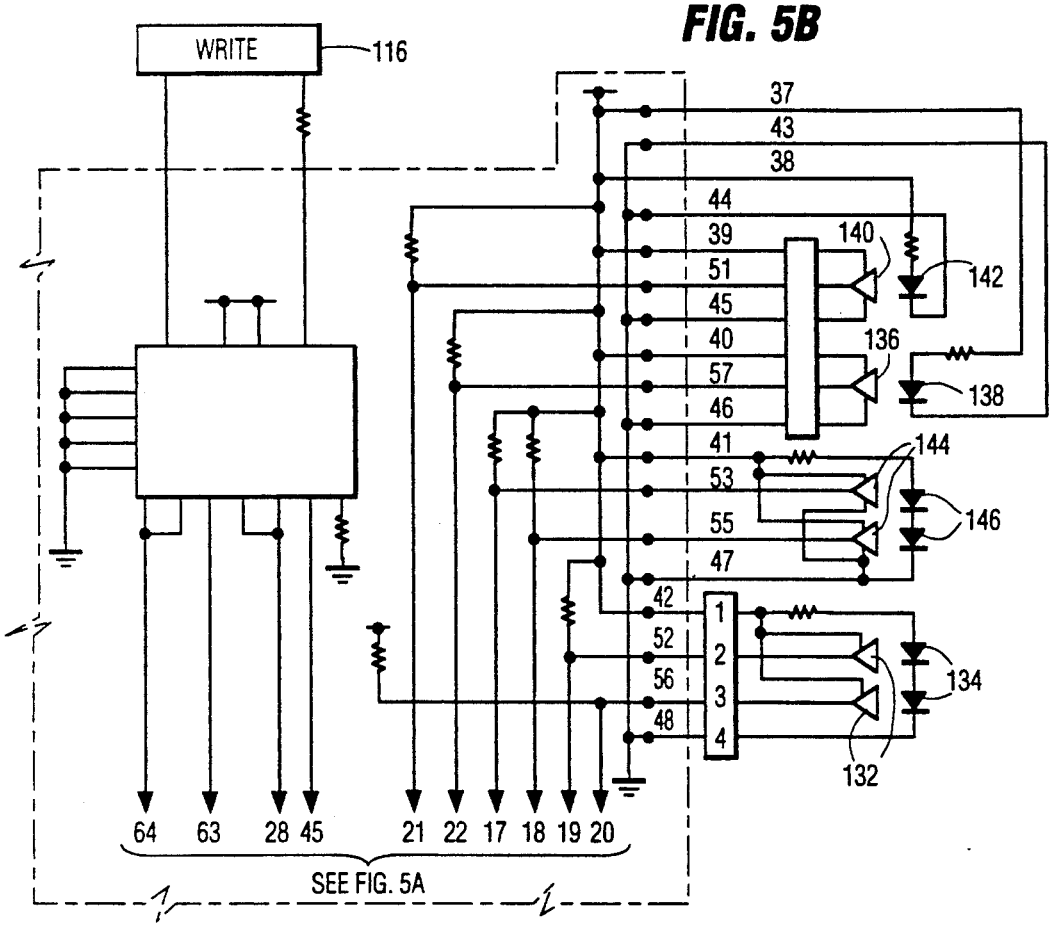
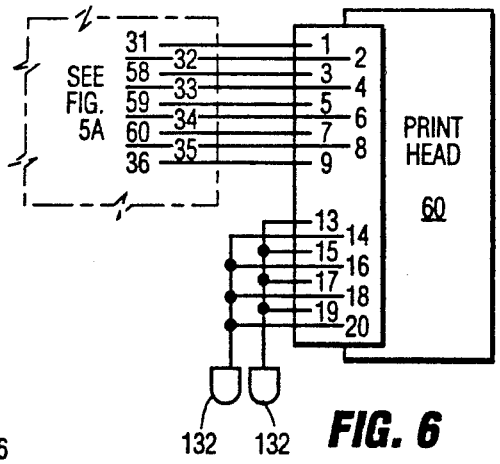
FIG. 6
FIG. 3
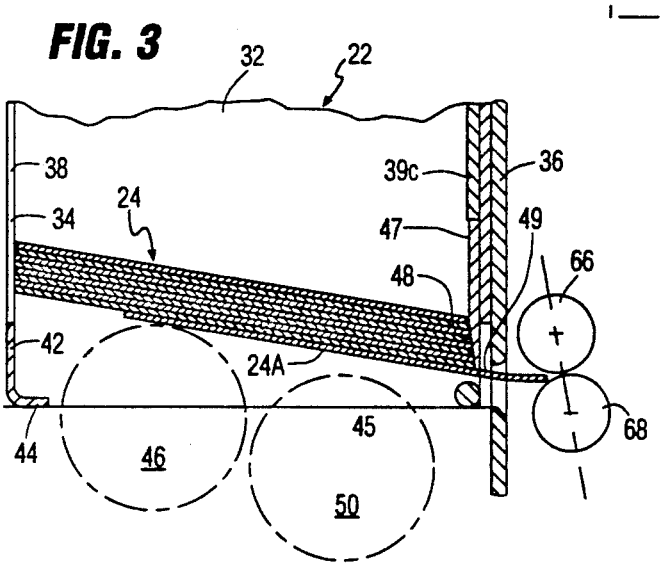

TICKET ORIGINATING AND PROCESSING DEVICE FOR TRANSIT VEHICLE

REFERENCE TO RELATED APPLICATION

This is a continuation of application Ser. No. 07/558,594 Jul. 27, 1990, now abandoned.

BACKGROUND OF THE INVENTION

The present invention relates to devices for originating tickets for use in a mass transit system and for processing such tickets. The present invention also relates to fare collection devices for use on mass transit vehicles.

Modern mass transit systems often provide their riders with a variety of options with respect to the type of ticket to be purchased by the rider. Multiple ride tickets are often sold for a lower price per ride than individual ride tickets, and the fare charged between different locations in the transportation area of many transportation systems is different. Accordingly, it is necessary for such systems to originate tickets of different values. If a multiple ride ticket is provided to the passenger, the transit system must provide a means for reducing the value of the ticket for each successive ride of the passenger.

Manual systems for reducing the value of a multiple ride ticket are well known, such as the use of a punch to remove a portion of the ticket designating one ride Also, most manual systems which provide for transfers from one vehicle to another of the mass transit system require a validation of the ticket at the end of the ride on the first vehicle, such as a stamp. Such systems generally require the supervision or attendance of a collector and also tend to delay the passenger.

Ticket originating vending machines do exist which directly respond to instructions from the ticket purchaser to produce a ticket for multiple rides, or with transfer capability, and such vending machines both print and magnetically encode the ticket. U.S. Pat. No. 4,376,942 of John E. Toth, Chandler R. Deming, and Anthony W. Cumo entitled THERMAL PRINTING SYSTEM describes an automatic ticket vending machine for a mass transit system which is provided with a thermal printing system and a magnetic transport system for encoding a magnetic stripe on a paper or plastic card. U.S. Pat. No. 4,381,705 of John B. Roes, Guy M. Kelly, Robert F. Case, and Chandler R. Deming entitled MODULAR TICKET HANDLING SYSTEM FOR USE IN AUTOMATIC TICKET PREPARATION SYSTEM describes a ticket vending machine in greater detail. Such automatic vending ticket originating machines are intended as free standing units and are provided with devices for handling money or credit cards.

It is an object of the present invention to provide a ticket originating device which operates in conjunction with a conventional farebox which is adapted to be used on a vehicle of a mass transportation system. The ticket originating device of the present invention is adapted to be mounted directly on the farebox of a motor vehicle, and is designed to convert the deposit of money in the farebox into the origination of a multiple ride ticket by the intervention of the vehicle operator.

It is also an object of the present invention t provide a ticket processing device which will respond to a previously issued ticket and modify the value of the ticket. A ticket purchased for multiple rides, or a combination ride, may then be processed in the ticket processing device of the present invention to change the value of the ticket to give effect to the present ride.

It is also an object of the present invention to provide a ticket processing device which will receive a ticket of a value sufficient to cover the cost of the present ride, and will process the ticket to remove it from circulation.

It is also an object of the present invention to provide a ticket processing device which receives blanks or cards in a cartridge and directly processes these blanks from the cartridge into tickets in order to minimize the likelihood of loss of blanks for tickets.

SUMMARY OF INVENTION

The present invention provides a ticket processing device for use on a mass transit vehicle in conjunction with a farebox or some other cash receiving and accounting device. Tickets are printed and encoded from preprocessed cards which preferably have a heat sensitive coating to respond to a thermal dot matrix printer and a linear stripe of material capable of responding to a magnetic field to become magnetically encoded.

The use of preprocessed cards is made practical by the provision of a cartridge for the cards. The cards are stacked in the cartridge in the offices of the mass transit company, and the sealed cartridge is transported to the vehicle in which it is to be used. Thus the cards are handled in fixed groups, rather than in bulk, minimizing the likelihood of theft of the cards for the purpose of producing forged tickets. The cartridge is placed in the ticket processing device, and the ticket processing device removes the cards one at a time, in sequence from the cartridge for the purpose of originating a ticket.

The operator is provided with a control keyboard and a display, and the supporting electronics permits the operator to print and encode tickets for values equal to multiple rides, a single ride, or a ride and a transfer. In addition, the ticket processing device is capable of processing tickets previously issued, either by the present ticket processing device of another vending unit, to reduce the value of the ticket by the amount of one ride or the like.

The ticket processing device of the present invention is enclosed compactly within a housing designed to be mounted on a conventional farebox or to be used in conjunction with some other cash receiving and accounting unit. The housing of the ticket processing device has a top provided with an opening and a ticket slot spaced from the opening. The ticket processing device is provided with means within the housing defining a pathway for the cards extending between the opening and the slot. A first portion of the pathway accommodates a removable elongated cartridge, and the cartridge has a channel which accommodates a stack of flat rectangular cards. The cartridge has an opening on one side thereof confronting the last card for transporting cards along the pathway.

The pathway has a second portion extending angularly from the first portion and confronting the opening in the one side of the cartridge. A feed wheel is mounted rotatably on the housing adjacent to an orifice in the end of the cartridge, and the feed wheel protrudes through the orifice into the cartridge, and the perimeter of the feed wheel engages the exposed bottom card of the stack. A motor is connected mechanically to the feed wheel to rotate the feed wheel in a direction to expel the contacting card through the slot. A printer is mounted on the housing having two abutting rolls confronting the opening of the cartridge, the rolls being disposed parallel to the axis of the feed wheel. The printer has means including the two rolls for advancing cards through the printer. The ticket processing device also has a transport system disposed along the pathway between the printer and the ticket slot in the top of the housing which is provided with means for magnetically encoding a strip of magnetically recordable material which is disposed on a card.

It will become apparent that the features of the printer, card transport mechanism and the electronic circuits that control these elements contribute to the invention and to its functions. These features will be described more fully in conjunction with the accompanying drawings.

BRIEF DESCRIPTION OF THE DRAWINGS

FIG. 3 is a fragmentary sectional view of the cartridge shown in FIG. 1.

FIG. 5A and 5B are fragmentary schematic electronic circuit diagrams for the ticket processing device of the present invention; and FIG. 6 through 9 are fragmentary schematic electronic circuit diagrams which enlarge portions of FIGS. 5A and 5B.

DESCRIPTION OF THE PREFERRED EMBODIMENT

Figure 1:
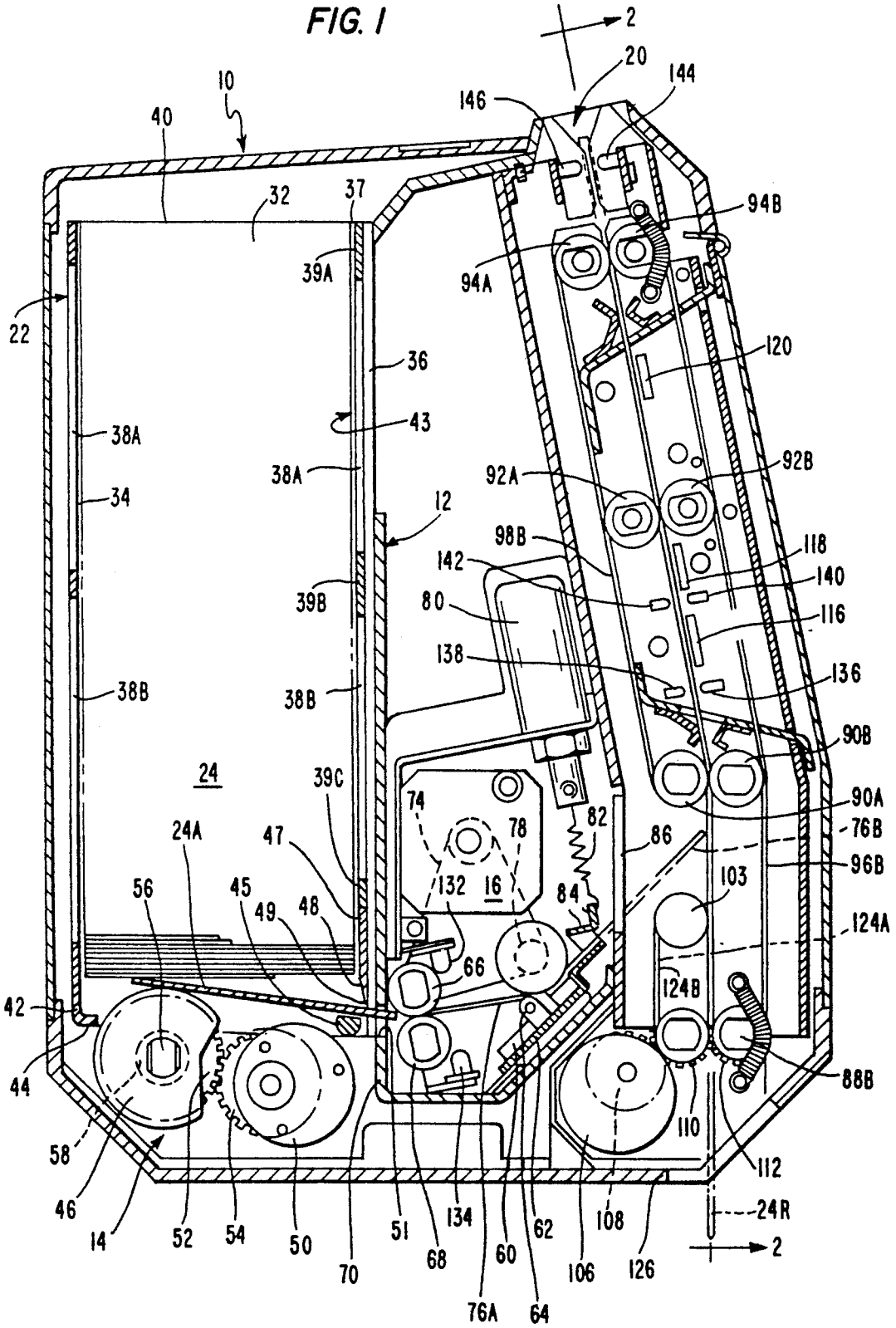
FIG. 1 is a vertical sectional view of a ticket processing device constructed according to the present invention, the view being taken along line 1—1 of FIG. 2.
Figure 2:
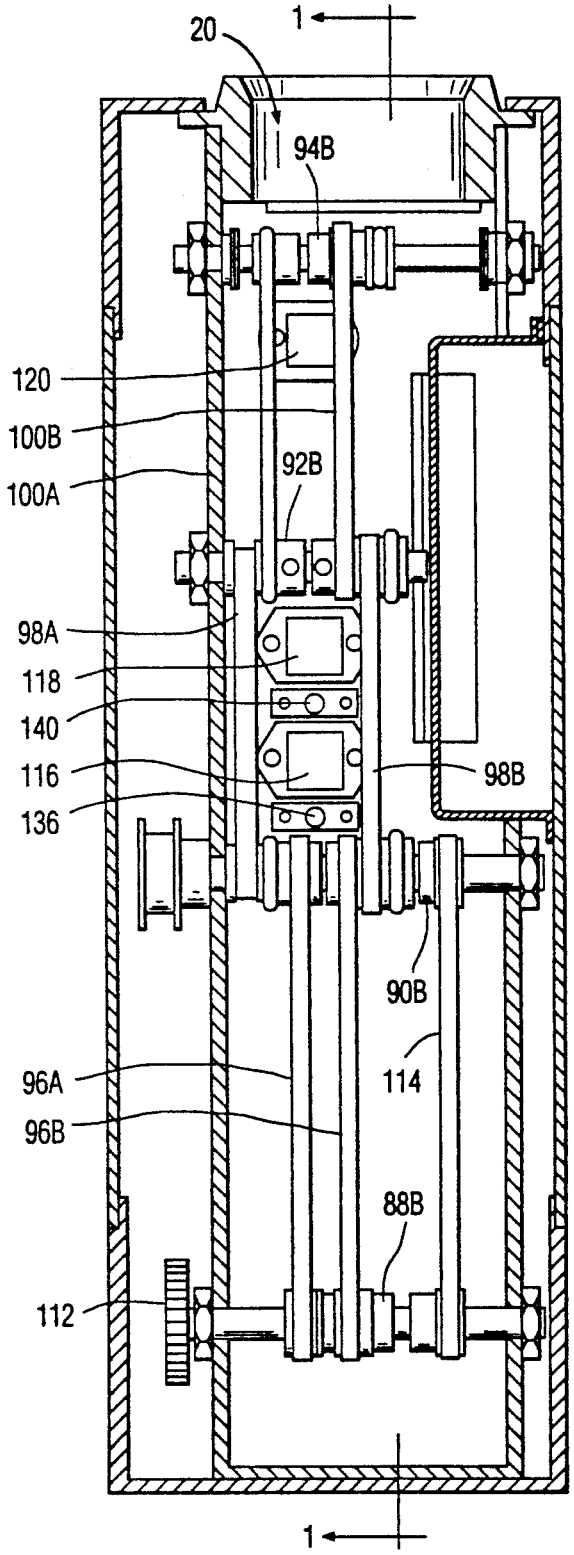
FIG. 2 is a sectional view of the ticket processing device of FIG. 1 taken along line 2—2 of FIG. 1.

As illustrated in FIGS. 1 through 3, a preferred construction of a ticket processing device according to the present invention has a housing 10 which contains a cartridge receiving unit 12, a card expelling unit 14 disposed adjacent to the cartridge receiving unit, a printer unit 16, a transport unit 18, and a ticket slot 20. A card holding cartridge 22 is disposed removably within the cartridge receiving unit 12 and contains a plurality of preprocessed blank cards 24 stacked within the cartridge 22.

Figure 4:
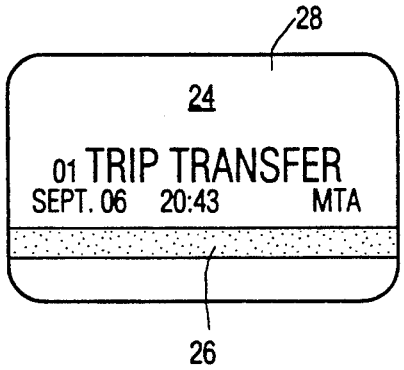
FIG. 4 is a plan view of one side of a ticket illustrating the printing achieved by the ticket processing device of the present invention.

Each card 24 is used to produce a transit ticket. The card is rectangular, and one side of the card is illustrated in FIG. 4, the reverse side of the card being plain. On the one side of the card 24, an elongated narrow stripe 26 extends parallel to and displaced from the central axis of elongation of the card, and the stripe is made of magnetic recording material of the type used on magnetic tape. The portion of the card from the stripe 26 to the remote edge of the card has a coating 28 of material which changes color in response to heat to permit use of a thermal printer.

The cartridge 22 has a pair of parallel walls 30 and 32 which are integral with an end wall 34, the end wall 34 being normal to the walls 30 and 32. The edges of the walls 30 and 32 opposite the end wall 34 are bent toward each other to form lips 36. The lips 36 support a flat elongated plate 37, and three spaced strips, one of the strips 39A being located at the end 40 of the cartridge 22 opposite the card expelling unit 14, the second strip 39B being disposed centrally of the lips 36, and the third strip 39C extending between the lips 36 at the end 42 of the cartridge 22 adjacent to and confronting the card expelling unit 14. The walls 30 and 32, the end wall 34, and the plate 37 form a rectangular channel 43 which extends through the cartridge and accommodates a stack of cards 24, as illustrated in FIG. 1. The end wall 34 and the plate 37 have openings 38A and 38B forming a housing. The housing is mounted to position the end wall 34 at an angle to the horizontal plate in order to cause the cards 24 to ride against the end wall 34. One end of the card at the bottom of the stack of cards abuts a lip 44 extending from the end wall 34 and the other end of the bottom card 24A abuts a rotatable pin 45 journaled on the walls 30 and 32 adjacent to the plate 37. The perimeter of a feed wheel 46 of the card expelling unit 14 engages the bottom card 24A and displaces it upwardly. An insert 47 at the lower end of the plate 37 of the cartridge 22 is provided with a beveled surface 48 which confronts the cards at the bottom of the stack and the pin 45 to form a narrow slot 51 of sufficient width to permit the passage of a single card. The surface of the insert 47 is beveled along a flat plane extending from the outer surface of insert 47 to the inner surface of the insert 47 to form the edge 49. The perimeter of the feed wheel 46 is cylindrical to increase the friction with the bottom card 24A and facilitate removal of the bottom card from the cartridge.

The feed wheel 46 is connected to a first electric motor 50 by means of meshed gears 52 and 54. The gear 52 is coupled to the shaft 56 of the feed wheel 46 by means of a one-way clutch 58 which permits the feed wheel 46 to rotate freely in the forward, clockwise direction as illustrated in FIG. 1, to transport a card toward the printer 16. FIG. 1 illustrates a card 24A in engagement with the feed wheel 46. The motor 50 is energized for a relatively short period by control of a shut-off mechanism described hereafter to feed a single card and to rotate the feed wheel 46 to move the bottom card 24A into engagement with the roller 66 and 68 of the printer 16 and the one-way clutch permits the feed wheel to rotate in response to movement of the card 24A induced by rollers 66 and 68 of the printer unit 16 and the one-way clutch 58 permits the feed wheel to rotate in response to movement of the card 24A induced by the rollers 66 and 68 of the printer unit 16.

The printer unit 16 contains a dot matrix thermal unit 60 which is provided with a heat sink 62 and is pivotally mounted on a shaft 64 disposed parallel to the axis of the feed wheel 46. A first roller 66 and a second roller 68 are mounted adjacent to an opening 70 to receive cards from the card expelling unit 14, such as the card 24A. The roller 66 is connected to a stepping motor 72 by a belt 74, and the roller 66 drives the roller 68 in the opposite direction from the roller 66 to draw the cards into the printer 16 one representative card 24A being illustrated. The rollers 66 and 68 advance the card along the pathway illustrated by the dashed line 76 to the dot matrix thermal unit 60. The dot matrix thermal unit 60 confronts a platen roller 78 which is rotatable on an axis parallel to the rollers 66 and 68 and is also connected to the stepping motor 72 by the belt 74. The platen roller 78 is constructed of rubber or soft plastic to facilitate moving cards along the pathway.

The dot matrix thermal unit 60, as illustrated in FIG. 1, is spaced sufficiently from the platen roller 78 that the platen roller can advance the card 24A along the portion 76A of the pathway 76 to confront the dot matrix thermal unit 60, and the stepping motor will cease rotation when the card 24A is in the proper position confronting the dot matrix thermal unit 60. Thereafter, a solenoid 80, acting through a spring 82 and a lever arm 84, will rotate the dot matrix thermal unit on the shaft 64 to engage the card 24A and sandwich the card between the platen roller 78 and the dot matrix thermal unit 60. By actuation of the dot matrix thermal unit 60, the surface of the card 24A confronting the dot matrix thermal unit 60 will be printed with a dot pattern. The process is repeated to provide the proper configuration of dots on the card to achieve the indications desired. After printing of a card has been achieved, the stepping motor 72 continues to drive the rollers 66 and 68 and the platen roller 78 to advance the card 24A through the printer unit 16 and through an opening 86 in the housing to drive the card into the transport unit 18.

The transport unit 18 has four pairs of rollers mounted for rotation in the housing 10, the rollers of the first pair being designated 88A and 88B, the rollers of the second pair being designated 90A and 90B, the rollers of the third pair being designated 92A and 92B, and the rollers of the forth pair being designated 94A and 94B. The rollers of each pair are disposed for rotation about axes parallel to the axis of the feed wheel 46. The rollers 88B and 90B carry a pair of belts 96A and 96B which are spaced from each other by a distance significantly shorter than the transverse axis of the cards 24. In like manner, rollers 90B and 92B carry a pair of belts 98A and 98B in spaced relation, the distance between the belts being significantly less than the transverse axis of the cards 24. Rollers 92B and 94B carry belts 100A and 100B which are parallel to each other and spaced by a distance less than the transverse axis of the cards 24. Rollers 90A, 92A, and 94A also carry corresponding belts 98A and 98B, and 100A and 100B, and the belts of rollers 90A, 92A, and 94A are in abutment with the corresponding belts carried by the rollers 90B, 92B, and 94B.

When a card 24A has been printed by the dot matrix thermal unit 60, the platen roller 78 drives the card forward under control of the stepping motor 72 so that the leading edge of the card abuts the belts 96A and 96B. A third motor 106 drives the rollers 88A and 88B through gears 108, 110, and 112 causing the belts 96A and 96B to transport a card 24A toward the rollers 90A and 90B. The rollers 90A and 90B are driven not only by the belts 96A and 96B, but by a drive belt 114 which extends between the rollers 88B and 90B. The card 24A thus follows the portion 76B of the pathway 76 into the transport unit 18.

The portion of the transport unit 18 extending between rollers 90A, 90B and rollers 92A, 92B will engage the card 24A between the belts 98A and 98B of rollers 90A and 92A and the belts 98A and 98B of rollers 90B and 92B. With the direction of the motor rotation in the forward direction, the confronting and abutting belts 98A and confronting belts 98B will engage the card 24A and transport it toward the ticket slot 20.

The transport unit 18 continues to transport the card 24A toward the ticket slot 20 in the region between the rollers 92A and 92B, and 94A and 94B. In this region, the confronting belts 100A which are driven by the rollers 92A and 94A and the confronting belts 100B driven by the rollers 92B and 94B engage the card 24A and transport it to the ticket slot 20.

The transport unit 18 is provided with a magnetic write head 116 disposed between the belts 98A and 98B adjacent to the roller 90B. Also, a magnetic read head 118 is disposed between the belts 98A and 98B adjacent to the roller 92B.

When originating a ticket, the card 24A enters the transport unit 18, and the magnetic stripe 26 of the card is encoded as the card passes over the write head 116. The read head 118 reads the encoded information from the stripe, and the electronic unit of the ticket processing unit compares and verifies the encoding. Thereafter, the card 24A is transported on the pair of belts 100A and the pair of belts 100B to the ticket slot 20.

A previously encoded ticket may be presented to the ticket processing device for reduction in the recorded value of the ticket equal to the value of the present ride. The ticket represented by a card, is inserted in the ticket slot 20 with the magnetic stripe facing the roller 94B (as illustrated in FIG. 2). The pair of belts 100A and the pair of belts 100B transport the card past the read head 120 to input the value of the ticket being processed. Thereafter, the ticket is transported on the pair of belts 100A and the pair of belts 100B to the pair of belts 98A and the pair of belts 98B to move the card to the region of the rollers 90A and 90B. Then the third motor 106 is reversed, and the card transported past the write head 116 to encode upon the stripe 26 of the ticket the new value of the ticket. The card is transported past the read head 118 which permits the information to be verified by the electronic unit, and if correct, the card is transported out of the ticket slot 20.

If the value of the ticket described above is reduced to zero, the ticket must be removed from circulation. This is achieved by reversing the direction of the third motor 106 and transporting the card toward the rollers 88A and 88B. An additional roller 102 is mounted between rollers 88A and 90A and carries additional belts 124B and 124A, the belt 124B being aligned with the belt 96B and the belt 124A being aligned with the belt 96A. The ticket to be removed from circulation is seized by the belts 96A, 124A, 96B, 124B and transported away from the transport unit 18 and through an opening 126 to a container, not illustrated.

Figure 5A:
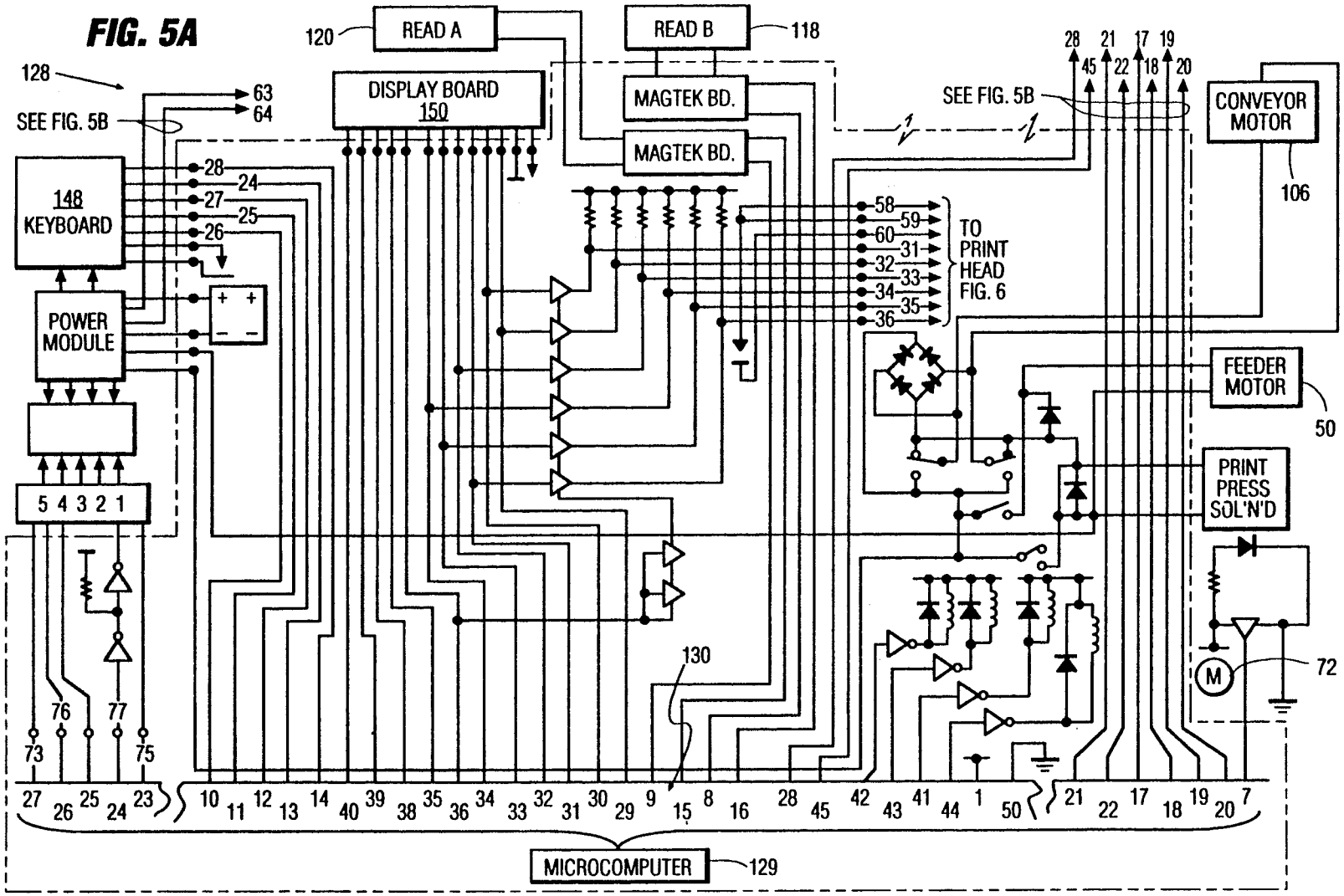
Figure 7:
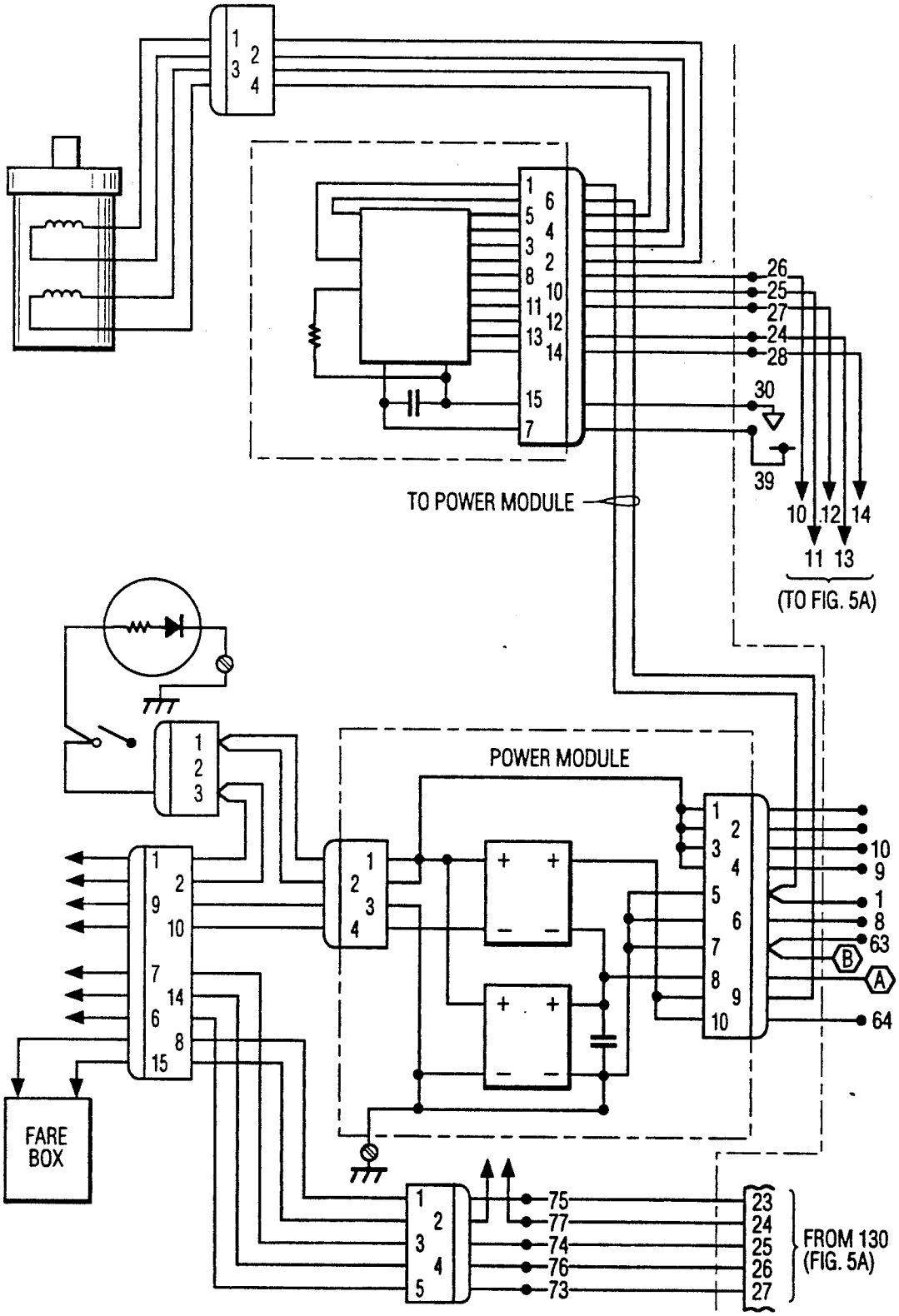
Figure 8:
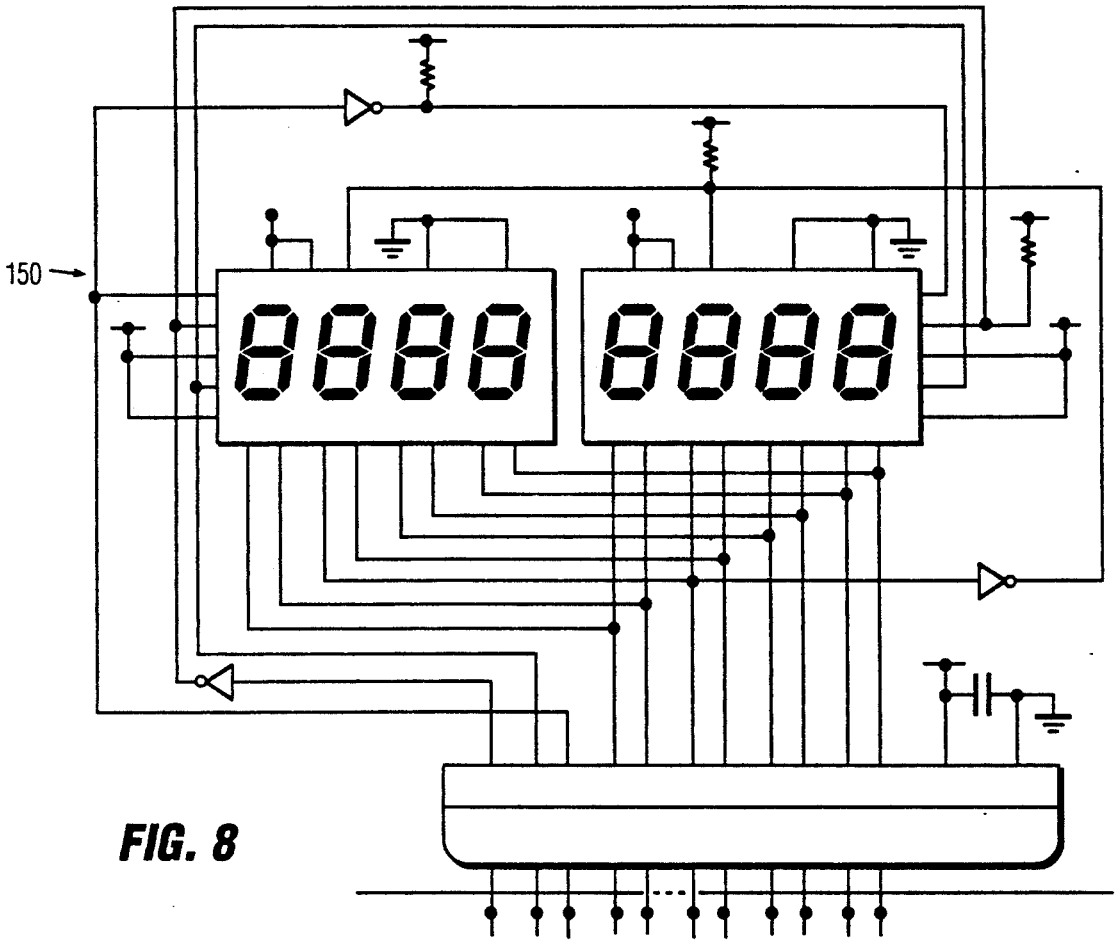
Figure 9:
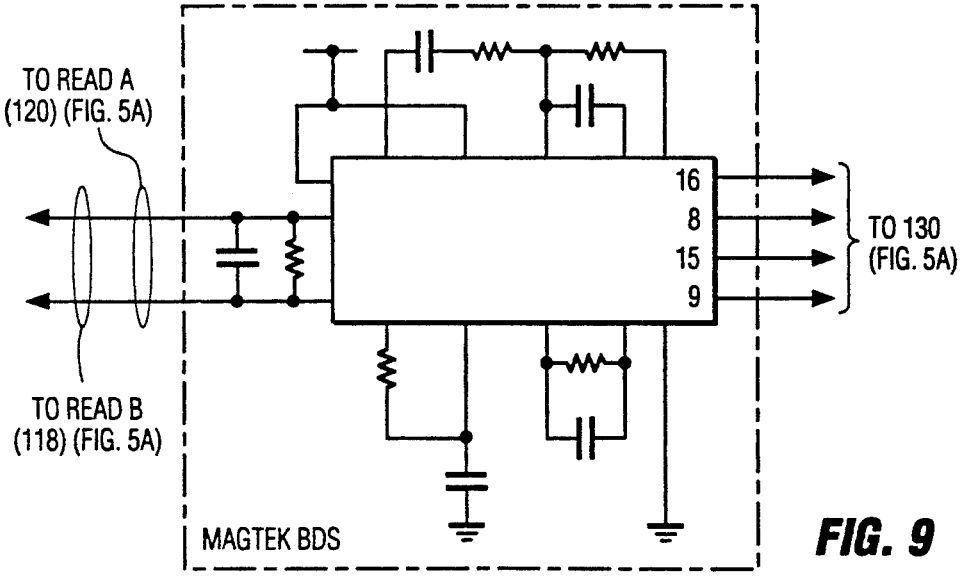

The electronics unit 128 for the ticket processing unit is illustrated in FIGS. 5A and 5B through FIG. 9. The electronics unit 128 is controlled by a microprocessor 129 which is programmed to produce the desired functions. The microprocessor 129 is connected to the terminal strip 130 as illustrated in FIG. 5A, and the microprocessor will not be further illustrated. The terminal strip 130 has a group of terminals connecting the microprocessor 129 to the sensors, illustrated in FIG. 5B. The sensors utilize light emitting diodes and light sensitive photocells, and a pair of these photocells 132 is mounted adjacent to the roller 66 of the printer unit 16. A pair of light emitting diode 134 is mounted adjacent to the cooperating roller 68, and hence the photocell 132 detects the presence of a card entering the printer un and deactivates the motor 50. Also, a timing circuit in the microprocessor 129 delays actuation of the dot matrix thermal printer unit 60 until the card 24A has advanced into proper position. Thereafter the microprocessor 129 establishes a fixed program for printing the card and transporting the card to the transport unit 18.

A second photocell unit 136 is positioned between the roller 90B and the write head 116 in the transport unit 18. A light emitting diode 138 confronts the photocell 136 permitting the presence of a card 24A between the diode 138 and the photocell 136 to interrupt the transmission of light between the diode 138 and the photocell 136. These elements 136 and 138 provide the signal to the microprocessor 129 to commence writing on the magnetic strip of a card being originated to encode that card with the value of the ticket, or other information. For a ticket being modified or revalued, the sensors 136 and 138 not only provide the signal to the microprocessor 129 to provide the write function, but also the signal to reverse the third motor 106 to transport the ticket toward the ticket slot 20.

A third photocell 140 is mounted between the write head 116 and the read head 118, and this photocell is provided with illumination from a light emitting diode 142. When a card breaks the light beam from the diode 142 to the photocell 140, the photocell 140 provides a signal to the microprocessor 129 to actuate the read function of the read head 118 and to verify or compare the information from the read head 118 with the input data. Photocell 140 can be used to turn on the write head 116 when the card is traveling in the opposite direction.

A fourth sensor is illustrated in FIG. 1 adjacent to the ticket slot 20, and this sensor has a pair of photocells 144 mounted adjacent to each other on one side of the pathway 76B at the ticket slot 20 and a pair of light emitting diodes 146 mounted on the other side of the pathway 76B to illuminate each of the photocells 144. When a card has been processed and is leaving the ticket slot 20, the photocells 144 and LEDs 146 produce a signal for the microprocessor 129 to terminate all functions as far as that card is concerned. Elements also produce a signal for the microprocessor 129 if a ticket is inserted into the ticket slot 20, and this signal causes the motor 106 to start and transport the card past the reading head 120 to sense the value of the ticket, and thereafter to transport the ticket to the write head 116 to be modified.

The microprocessor controls the dot matrix thermal printer unit 60, as illustrated in FIGS. 5A and 6. The microprocessor 129 also controls the write head 116, and the read heads 118 and 120. In addition, the microprocessor controls the feed motor 50 and the third motor 106 for the transport unit 18, as illustrated in FIG. 5. The vehicle is provided with a keyboard 148 connected to the microprocessor and a display board 150, as illustrated in FIG. 5A. (better seen in FIG. 8). The keyboard 148 permits the operator to key in the amount or any ticket purchase, and the display provides verification of that amount for both the operator and the purchaser. Since these individual circuits and suitable software for use in the microprocessor are known to the art, no further description will be presented.

Those skilled in the art will devise modification of the foregoing devices and applications for the present invention which have not been specifically set forth in this specification. Therefore, it is intended that the scope of the present invention not be limited by the foregoing specification, but rather only by the appended claims.

The invention claimed is:

1. A ticket processing device for use on a mass transportation vehicle comprising, in combination:

a housing, having a substantially horizontal top, provided with an opening therein for receiving a stack of flat cards, and a slot, for accommodating tickets, at said top of said housing spaced from said opening;

means within the housing forming a U-shaped pathway having a central axis, the central axis of the pathway being linear through a first, vertical portion thereof adjacent to the opening, including an elongated cartridge for accommodating said stack of flat cards, said cartridge being disposed within the first, vertical portion of the pathway, said cartridge having a slot on one sidewall, adjacent the bottom of said cartridge, for permitting the lowest card in the stack at a given time to be expelled;

said U-shaped pathway having a second portion with an initial part extending substantially horizontally from the first portion and a second part disposed at an acute angle upwardly to said initial part, said initial part of the second portion of the pathway confronting said slot in the one sidewall of the cartridge and being adapted to receive a card therefrom;

a printer mounted on the housing adjacent to the second portion of said pathway, said printer having two abutting rollers confronting said slot in the sidewall cartridge and disposed parallel thereto, said printer having means including the two rollers for advancing cards through the printer and along the pathway;

a transport system comprising a plurality of vertically movable belts and rollers for driving said belts, disposed along the pathway between the printer and the ticket slot in the top of the housing.

2. A device as defined in claim 1, further comprising an orifice at the bottom end of said cartridge, a feed wheel rotatably mounted on the housing adjacent to the orifice, said feed wheel protruding through the orifice into the cartridge and the perimeter of the feed wheel abutting the exposed bottom card of the stack, a motor mechanically connected to the feed wheel to rotate the feed wheel in a direction to expel the bottom card through the slot.

3. A ticket processing device for use on a mass transportation vehicle comprising the combination of claim 1, wherein the cartridge has four sides disposed in a rectangular structure, the slot in the cartridge sidewall having a downwardly extending bevel from the inside of the cartridge.

4. A ticket processing device for use on a mass transportation vehicle comprising the combination of claim 2, wherein the perimeter of the feed wheel is cylindrical.

5. A ticket processing device for use on a mass transportation vehicle comprising the combination of claim 2, wherein the axis of the feed wheel is disposed in a plane parallel to the one side of the cartridge closer to the opposite side of the cartridge than to the one side.

6. A ticket processing device for use on a mass transportation vehicle comprising the combination of claim 1, wherein the printer has a stepping motor mechanically connected to the two rollers to rotate the rollers and advance cards into the printer, in combination with a one-way clutch mechanically connected between the motor and the feed wheel, said one-way clutch being mounted to free wheel in the advancing position along the pathway.

7. A ticket processing device for use on a mass transportation vehicle comprising, in combination with a housing, having a substantially horizontal top, provided with a slot in the top thereof for both receiving and dispensing a ticket in the form of a flat card of standard dimensions and shape;

a vertical stack of blank standard cards disposed within the housing, including means for delivering a single standard card on demand, each of said cards having a portion coated with a magnetizable material and a surface adapted to receive printing;

means for transporting said standard cards one at a time along a U-shaped pathway extending from said vertical stack of standard cards to said ticket slot, an elongated cartridge for holding said vertical stack of cards;

a printer mounted within the housing confronting a first portion of the pathway of the transporting means, said first portion having a substantially horizontal first part and a second part disposed at an acute angle upwardly from said first part;

a magnetic encoder having a magnetic recording head mounted within the housing confronting a second portion of the pathway, a magnetic reader having a magnetic reading head mounted within the housing confronting a second portion of the pathway;

and computer means, adapted to receive an external numeric input, connected to the card transporting means, printer, encoder and reader, said computer means being responsive to the external numeric input to initiate removal of a standard card from the source, thereafter controlling movement of said card along the pathway, in a first direction, to the printer and actuation of the printer to print said numeric input on said card, controlling movement of said card along the pathway to the encoder and magnetically encoding said card with said numeric input, and thereafter controlling movement of said card along the pathway to the magnetic reader and actuating the reader to respond to the numeric information encoded on said card, and comparing said numeric information with the numeric input;

a second magnetic reader having a second magnetic reading head mounted within the housing confronting the third portion of the pathway, the computer means controlling actuation of the second magnetic reader, said computer means controlling said transporting means for transporting cards past the second magnetic reader in a reverse direction from said first direction, to determine the value encoded on a card and thereafter transporting the card past the magnetic encoder to change the value encoded on the card.

8. A ticket processing device for use on a mass transportation vehicle comprising a housing provided with a slot in the top thereof for both receiving and delivering a ticket in the form of a flat card of standard dimensions and shape, each of said standard cards having a portion coated with a magnetizable material and a surface adapted to receive printing, means for transporting standard cards one at a time along a U-shaped pathway extending from the ticket slot, a magnetic encoder having a magnetic recording head mounted within the housing confronting the pathway, a first reader having a magnetic reading head mounted within the housing confronting the pathway, a second reader having a second magnetic reading head mounted within the housing confronting the pathway;

computer means connected to the card transporting means, to said encoder, and to said first reader and second reader, said computer means being responsive to a standard card inserted into the ticket slot to actuate the transporting means to transport said card to the second reader, said computer means being responsive to the arrival of said standard card at said second reader to actuate the second reader to enter the numeric value encoded upon said card into the computer memory and to calculate a new value equal to the numeric value of the card less the value of any present services;

said computer means thereafter controlling movement of said card along the pathway to the encoder and actuating the encoder to magnetically encode said calculated numeric value on said card, thereafter said computer means controlling movement of said card along the pathway to the first magnetic reader and actuating the first reader to respond to the numeric information encoded on said card and compare said numeric information with the calculated numeric value;

said transporting means including a motor responsive to said computer means for enabling transport of said card in a first direction toward said slot and in a reverse direction from said slot, including means for reversing said motor to reverse the direction of movement.

9. A ticket processing device for use on a mass transportation vehicle comprising claim 8 in combination with means for storing a plurality of standard cards disposed in a fixed order with respect to each other between a first card and a last card disposed within the housing, said means having a second slot confronting the last standard card, the means for storing a plurality of standard cards positioning the last card on a first portion at an end of the pathway opposite the ticket slot, and a printer mounted within the housing confronting the pathway, said computer means being connected to the printer and being responsive to an external numeric input to actuate the transporting means to transport the last standard card in said storage means to the printer and hereafter to actuate the printer to imprint the value of the numeric input upon said card, and the computer means controlling the transporting means to transport said standard card along the pathway to the encoder and to actuate the encoder.

10. A ticket processing device comprising, in combination, a housing having a slot in the top thereof adapted to accommodate a ticket in the form and dimensions of a standard card, means, in the form of a cartridge, disposed within the housing for storing a plurality of standard cards in a vertical stack, each of said standard cards having one surface provided with a stripe of magnetic recording material and another surface, means within the housing forming a U-shaped pathway having an axis extending between the means for storing a plurality of standard cards and the slot in the housing;

the means for storing a plurality of standard cards including means for delivering at the bottom of said cartridge one card at a time on a first portion of the pathway;

a printer mounted on the housing aligned with the first portion of the pathway, said printer having independent means for advancing standard cards through the printer, and a transporting means disposed along a second portion of the pathway between the printer and the slot in the housing including two pairs of rollers rotatably mounted on the housing, the rollers of each paid being disposed parallel and adjacent to each other and on spaced planes normal to the second portion of the pathway, the first pair of rollers being disposed adjacent to the ticket slot in the housing and the second pair of rollers being disposed between the first pair of rollers and the printer, a first continuous belt mounted on and between one roller of the two pairs and a second continuous belt mounted on and between the other roller of the two pairs, a fifth roller rotatably mounted on the housing parallel to the rollers of the second pair, said fifth roller being spaced from the second pair of rollers and disposed on the opposite side of the printer from the second pair of rollers, a third continuous belt mounted on the fifth roller and the roller of the second pair remote from the printer, said third continuous belt directly confronting the printer and being adapted to engage the forward edge of a standard card being advanced outwardly by the means for advancing cards through the printer, and a motor mechanically coupled to the rollers, said motor rotating the rollers of each paid in opposite directions and the fifth roller in the same direction as the roller of the second pair remote from the printer, the portion of the third belt confronting the printer being translated toward the second pair of rollers to guide the leading edge of a standard card from the printer into the first and second belts between the rollers of the second pair.

11. A ticket processing device comprising the combination of claim 10, wherein the motor is reversible, in combination with a sixth roller rotatably mounted on the housing parallel to the fifth roller, said sixth roller abutting the third belt and being spaced from the second pair of rollers, means mechanically linking the sixth roller to the motor for rotating the sixth roller in the direction opposite the fifth rollers, and means mounted adjacent to the second portion of the pathway for detecting a card which should not be transported to the ticket slot and for reversing the direction of rotation of the motor to transport the card toward the sixth and fifth rollers and expel the card from the transport means.

12. A ticket processing device comprising the combination of claim 11, wherein the housing has an opening confronting the fifth and sixth rollers and the fifth roller is one roller of a third pair of parallel rollers disposed on a plane normal to the plane of the portion of the third belt confronting the printer, in combination with a fourth belt engaging and extending between the other roller of the third pair of rollers and the sixth roller.

* * * * *